US006247759B1

(12) United States Patent
Montgomery, Jr. et al.

(10) Patent No.: US 6,247,759 B1
(45) Date of Patent: Jun. 19, 2001

(54) CUTTING TOOL ASSEMBLY WITH REPLACEABLE SPRAY NOZZLE

(75) Inventors: Robert H. Montgomery, Jr., Everett, PA (US); Jan S. Grieveson, Ponteland (GB); Daniel C. Sheirer; William P. Losch, both of Bedford, PA (US)

(73) Assignee: Kennametal PC Inc., Monrovia, CA (US)

( * ) Notice: Subject to any disclaimer, the term of this patent is extended or adjusted under 35 U.S.C. 154(b) by 0 days.

(21) Appl. No.: 09/328,079

(22) Filed: Jun. 8, 1999

(51) Int. Cl.[7] ..... E21C 35/187
(52) U.S. Cl. ..... 299/81.3; 299/81.1; 175/424
(58) Field of Search ..... 299/81.1, 81.3, 299/104, 102; 175/424

(56) References Cited

U.S. PATENT DOCUMENTS

| | | | | |
|---|---|---|---|---|
| 4,333,687 | | 6/1982 | Barnstorf . | |
| 4,337,980 | * | 7/1982 | Krekeler | 299/102 |
| 4,657,308 | * | 4/1987 | Clapham | 299/81.3 |
| 4,678,238 | * | 7/1987 | Emmerich | 299/81.3 |
| 4,705,321 | * | 11/1987 | Hedlund | 299/81.3 |
| 5,007,684 | | 4/1991 | Parrott . | |
| 5,106,166 | * | 4/1992 | O'Neill | 299/104 |
| 5,234,258 | | 8/1993 | Komotzki . | |
| 5,378,048 | | 1/1995 | Parrott . | |
| 5,392,870 | | 2/1995 | Clapham | 175/427 |
| 5,498,069 | | 3/1996 | Siebenhofer et al. . | |

FOREIGN PATENT DOCUMENTS

| | | | | |
|---|---|---|---|---|
| 19809344 | | 2/1999 | (DE) | E21C/35/187 |
| 19809850 | | 6/1999 | (DE) | E21C/35/19 |
| 0010534 | | 4/1980 | (EP) | E21C/35/22 |
| 0207023 | | 12/1986 | (EP) | E21C/35/22 |
| 0231107 | | 8/1987 | (EP) | E21C/35/18 |
| 2102471 | | 2/1983 | (GB) | E21C/35/22 |
| 2141765 | | 1/1985 | (GB) | E21C/35/22 |
| 2328460 | | 2/1999 | (GB) | E21C/35/187 |
| 1550126A1 | * | 3/1990 | (SU) | 299/81.1 |

OTHER PUBLICATIONS

International Search Report for International application No. PCT/US00/14151, mailed Sep. 6, 2000.

Lemmes, F., "Meisselhalter MIT Ejektor–Schneidspurbeduesung," Gluckauf, De, Verlag Gluckauf, Essen vol. 134, No. 12, Dec. 10, 1998, pp. 68–0684.

* cited by examiner

*Primary Examiner*—David Bagnell
*Assistant Examiner*—John Kreck
(74) *Attorney, Agent, or Firm*—Kevin P. Weldon

(57) ABSTRACT

A cutting tool assembly includes a support block having a concealable outer surface portion, first and second bores, and first and second fluid passages. The first fluid passage is in fluid communication with the first bore and the second fluid passage. The second fluid passage has an axis and extends between the concealable outer surface portion and the second bore. Furthermore, the second bore and the second fluid passage are configured such that the axis may be extended through the second bore and beyond the support block without intersecting the support block. The cutting tool assembly also includes a replaceable spray nozzle having a body that extends into the first bore such that the spray nozzle is in fluid communication with the first fluid passage.

23 Claims, 2 Drawing Sheets

CUTTING TOOL ASSEMBLY WITH REPLACEABLE SPRAY NOZZLE

TECHNICAL FIELD

The invention relates to a cutting tool assembly having a replaceable spray nozzle.

BACKGROUND ART

Cutting tool assemblies for such applications as mining or road milling typically comprise a cutting tool, sometimes referred to as a cutting pick, rotatably mounted within a support block. The support block in turn is mounted onto a drum or other body, typically by welding, which in turn is driven by a suitable drive means. When a number of such support blocks carrying cutting tools are mounted onto a drum, and the drum is driven, the cutting tools will engage and break up the material sought to be mined or removed. The general operation of such a mining or construction machine is well known in the art.

It is also known to equip a cutting tool assembly with a spray nozzle for spraying fluid onto a cutting tool so as to reduce the potential for ignition of gases encountered during cutting or mining activities. U.S. Pat. No. 5,378,048, for example, discloses a water spray nozzle that is retained within a threaded bore of a pick box or support block using a resilient retaining ring. This nozzle is relatively complex in design and relatively costly to manufacture. Furthermore, the discharge end of the nozzle is contained within the bore of the pick box such that the nozzle does not limit wear of the pick box during use. Consequently, if the pick box is sufficiently worn away, it can no longer house the nozzle.

As another example, U.S. Pat. No. 5,392,870 discloses a cutting tool assembly including a spray nozzle that is completely contained within a bore of pick box. Consequently, this nozzle also does not limit wear of the pick box during use. In addition, water passages disposed in the pick box for providing water to the nozzle are configured such that they cannot be drilled out once the pick box is welded to a drum. As a result, when the passages become blocked, such as by calcium deposits, the cutting tool assembly is no longer useful for cutting operations that require a functioning spray nozzle.

DISCLOSURE OF INVENTION

It is an object of the invention to provide a new and improved cutting tool assembly having a support block and a replaceable spray nozzle mounted to the support block, wherein the spray nozzle is simple in design and relatively economical to manufacture.

In one embodiment of the invention, the cutting tool assembly comprises a support block having a tapered first bore. A replaceable spray nozzle including a unitary body is also provided, and the body has a tapered portion that engages the first bore so as to inhibit movement of the spray nozzle relative to the support block.

In another embodiment of the invention, the cutting tool assembly comprises a support block having a first bore, and a replaceable spray nozzle including a body that extends into the first bore. The body has a threaded portion that extends beyond the first bore, and a nut engages the threaded portion to inhibit movement of the spray nozzle relative to the support block.

In another embodiment of the invention, the cutting tool assembly comprises a support block having first and second outer surface portions, first and second bores, and first and second fluid passages. The first fluid passage is in fluid communication with the first bore and the second fluid passage. The second fluid passage has a second fluid passage axis and extends between the second outer surface portion and the second bore. Furthermore, the second bore and the second fluid passage are configured such that the second fluid passage axis may be extended through the second bore and beyond the support block without intersecting the support block. The cutting tool assembly also includes a spray nozzle having a body that extends into the first bore such that the spray nozzle is in fluid communication with the first fluid passage.

Advantageously, with such a configuration, the second fluid passage may be easily drilled out so as to ensure maximum fluid flow therethrough. The support block may also be provided with a channel extending between the first bore and the first outer surface portion, wherein the channel provides drill access to the first fluid passage.

In yet another embodiment of the invention, the cutting tool assembly comprises a support block having first and second outer surface portions, first and second bores, a channel, and first and second fluid passages. The channel extends between the first outer surface portion and the first bore, the first fluid passage extends between the first and second bores, and the second fluid passage extends between the second outer surface portion and the second bore. The cutting tool assembly further includes a replaceable spray nozzle having a body that extends into the first bore such that the spray nozzle is in fluid communication with the first fluid passage.

In each of the previous embodiments, the spray nozzle may be provided with an enlarged head that extends beyond the first bore. Advantageously, the enlarged head functions as a wear limiter to limit wear of a portion of the support block disposed behind the enlarged head.

While one embodiment of the new and improved cutting tool assembly is illustrated and disclosed, such disclosure should not be construed to limit the claims. It is anticipated that various modifications and alternative designs may be made without departing from the scope of the invention.

BEST MODE FOR CARRYING OUT THE INVENTION

Figure 1:
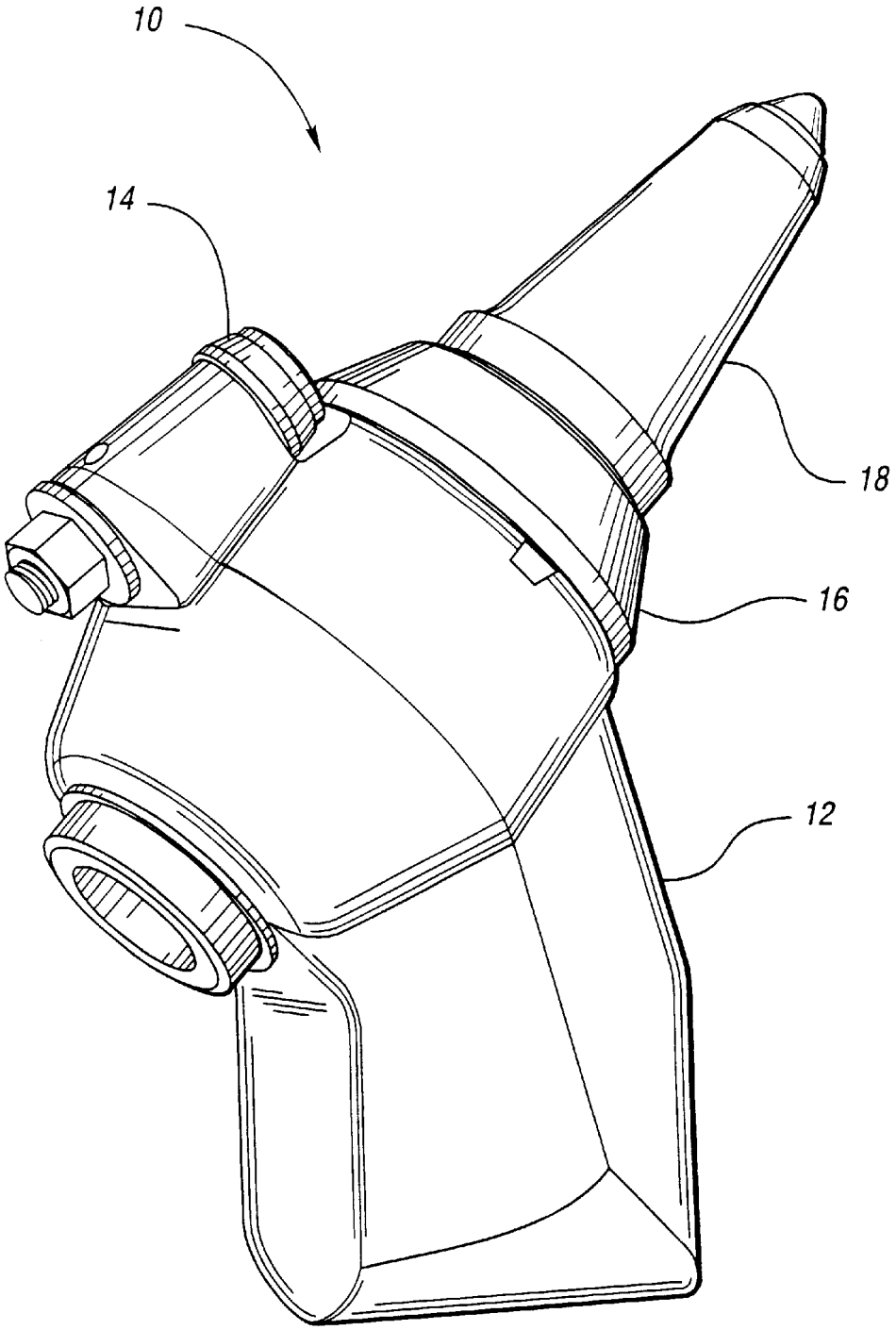
FIG. 1 is a perspective view of a cutting tool assembly showing one embodiment of the invention and including a support block, a replaceable spray nozzle, a sleeve and a cutting tool.
Figure 2:
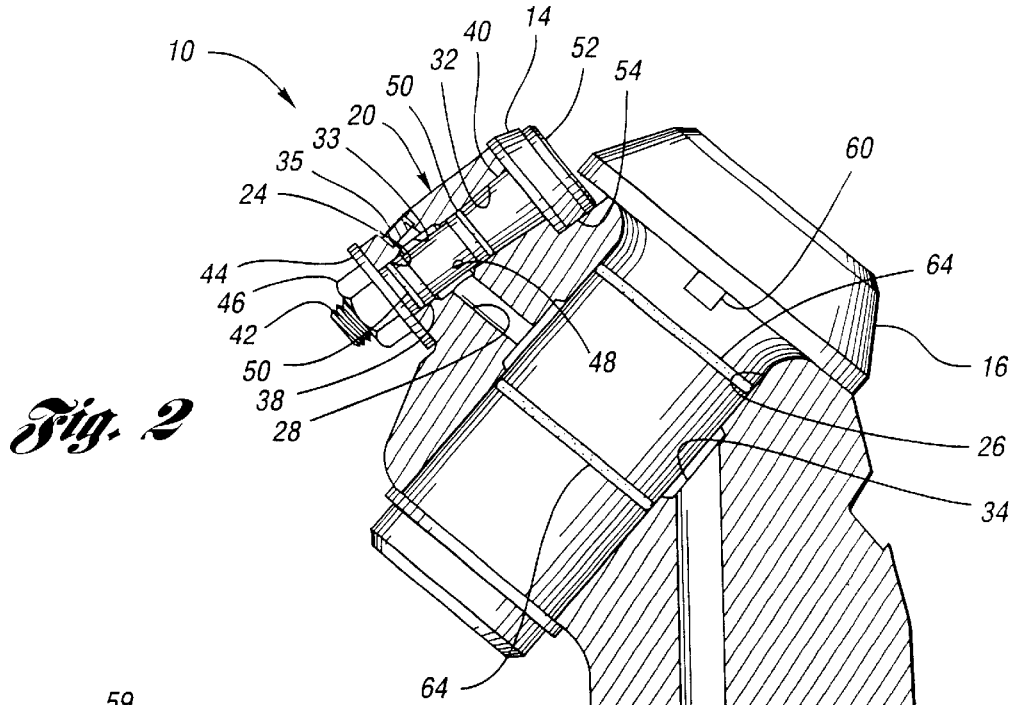
FIG. 2 is a side view of the cutting tool assembly of FIG. 1 with the support block shown in section and the cutting tool removed.

FIGS. 1 and 2 show one embodiment of a cutting tool assembly 10 according to the invention for use in mining and cutting operations. The cutting tool assembly 10 includes a support block 12, a replaceable spray nozzle 14 removably connected to the support block 12, a tool sleeve 16 that is also removably connected to the support block 12 , and a cutting tool 18 disposed within the tool sleeve 16.

The support block 12 is adapted to be connected to a rotatable drum (not shown) in any suitable manner, such as by welding, so that the cutting tool 18 may be driven into material sought to be removed or mined. The support block 12 has an outer surface that includes first and second outer surface portions 20 and 22, respectively. The first outer surface portion 20 remains exposed during use, while the second outer surface portion 22 is concealed when the support block 12 is connected to the drum.

Figure 3:
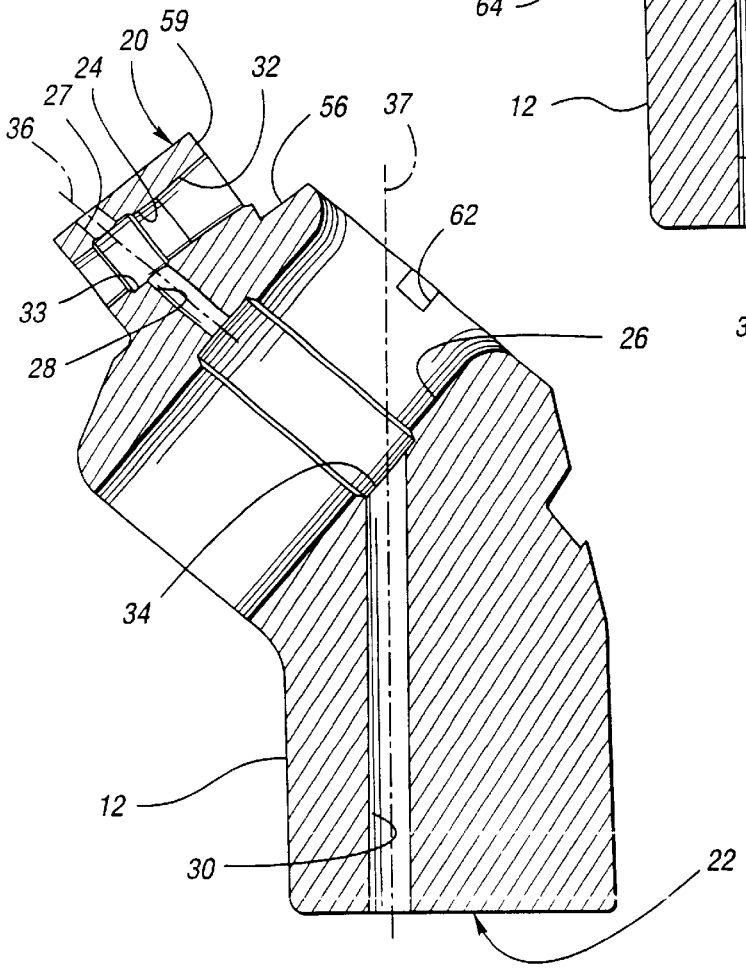
FIG. 3 is a sectional view of the support block of FIG. 1 with the replaceable spray nozzle and the sleeve removed.

As shown in FIGS. 2 and 3, the support block 12 further includes first and second bores 24 and 26, respectively, a channel 27, and first and second fluid passages 28 and 30, respectively, for supplying fluid such as water to the spray nozzle 14. In this embodiment, the first and second fluid passages 28 and 30 are generally straight.

The first bore 24 is configured to receive the spray nozzle 14, and includes a tapered portion 32 having a taper angle in the range of one to forty-five degrees. In a preferred embodiment, the taper angle is in the range of five to fifteen degrees. The first bore 24 further includes a first annular fluid groove 33 in fluid communication with the channel 27 and the first fluid passage 28.

The second bore 26 is configured to receive the tool sleeve 16, and includes a second annular fluid groove 34 in fluid communication with the fluid passages 28 and 30.

The channel 27 extends between the first outer surface portion 20 and the first annular fluid groove 33. A plug 35 may be inserted into the channel 27 to inhibit fluid loss from the channel 27. Preferably, the plug 35, which may have an allen or straight head, threadably engages the channel 27 and is recessed below the first outer surface portion 20 to inhibit wear of the plug 35. The first fluid passage 28 extends between the annular fluid grooves 33 and 34, and as shown in this embodiment, preferably shares a common first axis 36 with the channel 27.

The second fluid passage 30 extends between the second outer surface portion 22 and the second annular fluid groove 34, and has a second axis 37. As shown in FIG. 3, in this embodiment, the support block 12 and the second fluid passage 30 are preferably configured such that the second axis 37 may be extended through the second bore 26 and beyond the support block 12 without intersecting the support block 12. Advantageously, with such an arrangement, the fluid passages 28 and 30 may be easily cleaned. For example, when the spray nozzle 14, tool sleeve 16, cutting tool 18 and plug 35 are removed from the support block 12, a drill bit (not shown) or other cleaning device may be easily inserted into the fluid passages 28 and 30 so as to remove calcium deposits or other material therefrom. Consequently, the useful life of the cutting tool assembly 10 may be extended significantly beyond normal life expectancies of prior cutting tool assemblies.

As shown in FIGS. 1 and 2, the spray nozzle 14 of this embodiment includes a unitary, elongated body 38 having a tapered portion 40 and a threaded portion 42 that extends beyond the first bore 24 when the spray nozzle 14 is properly installed in the first bore 24. The tapered portion 40 of the body 38 frictionally engages the tapered portion 32 of the first bore 24 to effect a taper lock between the spray nozzle 14 and the support block 12. The taper lock serves to inhibit movement of the spray nozzle 14 relative to the support block 12. A locking washer 44 and a nut 46, which engages the threaded portion 42, are also preferably used to further inhibit movement of the spray nozzle 14 relative to the support block 12. In addition, the body 38 includes a fluid inlet 48 in fluid communication with the first annular fluid groove 33. One or more seals, such as O-rings 50, may also be placed around the body 38 on either side of the inlet 48 to inhibit fluid flow away from the inlet 48.

The spray nozzle 14 further includes an enlarged head 52 having a flat 54 that engages a corresponding flat 56 on the support block 12 to inhibit rotational movement of the spray nozzle 14 relative to the support block 12. The head 52 also includes a fluid outlet (not shown) in fluid communication with the fluid inlet 48 for discharging fluid onto the cutting tool 18. Preferably, the head 52 is dimensioned and configured to function as a wear limiter to limit wear of a portion 59 of the support block 12 located behind the head 52. Such wear may be caused by material encountered during a mining or cutting activity. Because the portion 59 of the support block 12 defines the bore 24, it is desirable to limit wear of this portion 59 so that the support block 12 is able to receive the spray nozzle 14. Advantageously, if the head 52 becomes worn away to such an extent that the spray nozzle 14 cannot function properly, the spray nozzle 14 may simply be replaced.

The spray nozzle 14 preferably comprises machined, hardened steel having a sufficient hardness to inhibit wear of the head 52. For example, the spray nozzle 14 may comprise machined 4140 steel. Alternatively, the spray nozzle 14 may be made of any suitable material and in any suitable manner, such as by casting.

The tool sleeve 16 has a bore (not shown) for receiving the cutting tool 18, which may be connected to the tool sleeve 16 in any suitable manner. The tool sleeve 16 preferably has one or more projections 60 that engage corresponding notches 62 in the support block 12 to inhibit rotational movement of the tool sleeve 16 relative to the support block 12. Alternatively, the support block 12 may be provided with one or more projections that engage corresponding notches in the tool sleeve 16. The tool sleeve 16 also includes one or more seals, such as O-rings 64, for inhibiting fluid flow away from the annular fluid groove 34.

To assemble the cutting tool assembly 10, the support block 12 is welded to a rotatable drum (not shown) so that the second fluid passage 30 is in fluid communication with a fluid passage (not shown) in the drum, and so that the support block 12 is sufficiently sealed to the drum. The spray nozzle 14 is then inserted into the first bore 24 of the support block 12, and the locking washer 44 and nut 46 are mounted on the threaded portion 42 of the spray nozzle 14 to secure the spray nozzle 14 to the support block 12. Next, the tool sleeve 16 is inserted into the second bore 26 of the support block 12 so that the projections 60 engage the notches 62. The cutting tool 18 is then inserted into the tool sleeve 16 and secured to the tool sleeve 16 in any suitable manner.

To use the cutting tool assembly 10, water is supplied to the second fluid passage 30 by the fluid passage in the drum. The water then flows through the second annular groove 34 to the first fluid passage 28. Next, the water flows through the first annular groove 33 and into the fluid inlet 48. The water is then sprayed onto the cutting tool 18 by the spray nozzle 14 to reduce the potential for ignition of gases encountered during cutting or mining activities.

While an embodiment of the invention has been illustrated and described, it is not intended that this embodiment illustrates and describes all possible forms of the invention. Rather, the words used in the specification are words of description rather than limitation, and it is understood that various changes may be made without departing from the spirit and scope of the invention.

What is claimed is:

1. A cutting tool assembly comprising:

a support block having first bore; and a replaceable spray nozzle including a unitary body having a portion that engages the first bore so as to inhibit movement of the spray nozzle relative to the support block wherein the body of the spray nozzle includes a threaded portion that extends beyond the first bore, and the cutting tool assembly further comprises a nut that engages the threaded portion to further inhibit movement of the spray nozzle relative to the support block.

2. The cutting tool assembly of claim 1 wherein the first bore has a taper angle in the range of five to fifteen degrees.

3. The cutting tool assembly of claim 1 wherein the spray nozzle further includes an enlarged head that extends beyond the first bore, the enlarged head functioning as a wear limiter to limit wear of a portion of the support block disposed behind the enlarged head.

4. The cutting tool assembly of claim 1 wherein the support block has a second bore having at least one of a bore notch and a bore projection, and the cutting tool assembly further comprises a sleeve disposable in the second bore and having at least one of a sleeve projection and a sleeve notch engageable with the at least one bore notch and bore projection to inhibit rotational movement of the sleeve relative to the support block.

5. The cutting tool assembly of claim 1 wherein the support block further has a first outer surface portion, a channel extending between the first outer surface portion and the first bore, and a first fluid passage in fluid communication with the first bore for providing fluid to the spray nozzle, wherein the channel and the first fluid passage have a common axis.

6. The cutting tool assembly of claim 5 wherein the support block further has a second outer surface portion, a second bore, and a generally straight second fluid passage extending between the second outer surface portion and the second bore, and wherein the first fluid passage extends between the first and second bores such that the first and second fluid passages are in fluid communication with each other.

7. The cutting tool assembly of claim 6 wherein the second fluid passage has a second fluid passage axis, and the second bore and the second fluid passage are configured such that the second fluid passage axis may be extended through the second bore and beyond the support block without intersecting the support block.

8. The cutting tool assembly of claim 1 wherein the support block further has a second outer surface portion, a second bore, a first fluid passage in fluid communication with first bore and second bore, and a second fluid passage extending between the second outer surface portion and the second bore, wherein the second fluid passage is in fluid communication with the first bore for providing fluid to the spray nozzle.

9. A cutting tool assembly comprising:

a support block having a first bore;

a replaceable spray nozzle including a body that extends into the first bore, the body having a threaded portion that extends beyond the first bore; and a nut that engages the threaded portion to inhibit movement of the spray nozzle relative to the support block.

10. The cutting tool assembly of claim 9 wherein the spray nozzle further includes an enlarged head that extends beyond the first bore, the enlarged head functioning as a wear limiter to limit wear of a portion of the support block disposed behind the enlarged head.

11. The cutting tool assembly of claim 9 wherein the support block further includes a second bore having a notch, and the cutting tool assembly further comprises a sleeve disposable in the second bore and having a projection engageable with the notch to inhibit rotational movement of the sleeve relative to the support block.

12. The cutting tool assembly of claim 9 wherein the support block further has a first outer surface portion, a channel extending between the first outer surface portion and the first bore, and a first fluid passage in fluid communication with the first bore for providing fluid to the spray nozzle, wherein the channel and the first fluid passage have a common axis.

13. The cutting tool assembly of claim 12 wherein the support block further has a second outer surface portion, a second bore, and a generally straight second fluid passage extending between the second outer surface portion and the second bore, and wherein the first fluid passage extends between the first and second bores such that the first and second fluid passages are in fluid communication with each other.

14. The cutting tool assembly of claim 13 wherein the second fluid passage has an axis, and the second bore and the second fluid passage are configured such that the axis may be extended through the second bore and beyond the support block without intersecting the support block.

15. The cutting tool assembly of claim 9 wherein the support block further has a concealable outer surface portion, a second bore, and a generally straight fluid passage extending between the concealable outer surface portion and the second bore, wherein the fluid passage is in fluid communication with the first bore for providing fluid to the spray nozzle.

16. A cutting tool assembly comprising:

a support block having first and second outer surface portions, first and second bores, and first and second fluid passages, the first fluid passage being in fluid communication with the first bore and the second fluid passage, the second fluid passage having a second fluid passage axis an d extending between the second outer surface portion and the second bore, wherein the second bore and the second fluid passage are configured such that the second fluid passage axis may be extended through the second bore and beyond the support block without intersecting the support block; and a spray nozzle having a body that extends into the first bore such that the spray nozzle is in fluid communication with the first fluid passage.

17. The cutting tool assembly of claim 16 wherein the support block has a channel that extends between the first outer surface portion and the first bore, wherein the channel and the first fluid passage have a common axis.

18. The cutting tool assembly of claim 17 wherein the body of the spray nozzle includes a threaded portion that extends beyond the first bore, and the cutting tool assembly further comprises a nut that engages the threaded portion to further inhibit movement of the spray nozzle relative to the support block.

19. The cutting tool assembly of claim 18 wherein the spray nozzle further includes an enlarged head attached to the body at an end opposite the threaded portion, the enlarged head extending beyond the first bore and functioning as a wear limiter to limit wear of a portion of the support block disposed be hind the enlarged head.

20. A cutting tool assembly comprising:

a support block having first and second outer surface portions, first and second bores, a channel, and first and second fluid passages, the channel extending between the first outer surface portion and the first bore, the first fluid passage extending between the first and second bores, and the second fluid passage extending between the second outer surface portion and the second bore; and a replaceable spray nozzle having a body that extends into the first bore such that the spray nozzle is in fluid communication with the first fluid passage wherein the body of the spray nozzle includes a threaded portion that extends beyond the first bore, and the cutting tool assembly further comprises a nut that engages the threaded portion to further inhibit movement of the spray nozzle relative to the support block.

21. The cutting tool assembly of claim 20 wherein the first fluid passage is generally straight, and the channel and the first fluid passage have a common axis.

22. The cutting tool assembly of claim 20 wherein the second bore has an annular groove in fluid communication with the first and second fluid passages.

23. The cutting tool assembly of claim 20 wherein the spray nozzle further includes an enlarged head that extends beyond the first bore, the enlarged head functioning as a wear limiter to limit wear of a portion of the support block disposed behind the enlarged head.

* * * * *